US005392596A

United States Patent [19]

Holsapple et al.

[11] Patent Number: 5,392,596

[45] Date of Patent: Feb. 28, 1995

[54] COMBUSTOR ASSEMBLY CONSTRUCTION

[75] Inventors: Alan C. Holsapple, Poway, Calif.; James E. Shaffer, Maitland, Fla.

[73] Assignee: Solar Turbines Incorporated, San Diego, Calif.

[21] Appl. No.: 171,049

[22] Filed: Dec. 21, 1993

[51] Int. Cl.[6] ..... F23R 3/42; F02C 7/20

[52] U.S. Cl. ..... 60/39.32; 60/753; 431/353

[58] Field of Search ..... 60/752, 753, 757, 39.31, 60/39.32, 755, 760; 431/353; 416/241 B

[56] References Cited

U.S. PATENT DOCUMENTS 4,459,101 7/1984 Doherty ..... 431/353
4,555,901 12/1985 Wakeman et al. ..... 60/752
4,722,825 2/1988 Goldstein ..... 123/193.2
4,841,927 6/1989 Slee ..... 419/8

*Primary Examiner*—Timothy S. Thorpe
*Attorney, Agent, or Firm*—Calvin E. Glastetter

[57] ABSTRACT

A combustor assembly having a preestablished rate of thermal expansion is mounted within a gas turbine engine having a preestablished rate of thermal expansion being greater than the preestablished rate of thermal expansion of the combustor assembly. The combustor assembly is constructed of a inlet end portion, a outlet end portion and a plurality of combustor ring segments positioned between the end portions. A retaining ring is positioned radially adjacent the combustor ring segments to allow for thermal radial expansion of the combustor ring segments while maintaining radially compressive force on the combustor ring segments and distributing force evenly along the combustor ring.

9 Claims, 3 Drawing Sheets

COMBUSTOR ASSEMBLY CONSTRUCTION

TECHNICAL FIELD

This invention relates generally to a gas turbine engine and more particularly to an arrangement for a combustor assembly.

BACKGROUND ART

"The Government of the United States of America has rights in this invention pursuant to Contract No. DE-AC02-92CE40960 awarded by the U.S. Department of Energy."

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

The gases within the combustor typically range from between 2000 degrees to at least 2500 degrees Fahrenheit. Since the efficiency and work output of the turbine engine are related to the entry temperature of the incoming gases, at the turbine section, there is a trend in gas turbine engine technology to increase the gas temperature. A consequence of this is that the materials of which the combustor, blades and vanes are made assume ever-increasing importance with a view to resisting the effects of elevated temperature.

Combustors historically have been made of metals such as high temperature steels. More recently they are made of nickel alloys. It has been found necessary to provide internal cooling passages in order to prevent melting. Ceramic coating can enhance the heat resistance of the turbine components. In specialized applications, nozzle guide vanes and blades are being made entirely of ceramic, thus, imparting resistance to even higher gas entry temperatures and requiring higher temperatures within the combustor.

However, if the combustor is made of ceramic, which have a different chemical composition, physical property and coefficient of thermal expansion to that of a metal supporting structure, then undesirable thermal stresses will be set up between the combustor and its supports when the engine is operating. Such undesirable thermal stresses cannot adequately be contained by cooling.

Furthermore, conventional assembly techniques and methods will require alternative designs, processes and assembly techniques. The structural components of the combustor and the assembly of the combustor within the gas turbine engine will need to be rethought.

Historically, using metallic components, a combustor design has used a multipiece design of segments one overlaps another. The segments are rigidly secured one to another by braze, bolts and/or welding. As an alternative, the combustor has been formed from a single piece. With a ceramic combustor, the integrity of the material and the construction thereof can drastically increase cost and can result in premature failure due to flaws in the surface. The larger the physical size of the ceramic shape the lesser the likelihood of producing a component having structural integrity. The sliding friction between the ceramic combustor and the supporting structure creates a contact tensile stress on the ceramic that will cause surface deterioration. If this deterioration in the surface of the ceramic occurs in a tensile stress zone of the combustor the generated surface flaw can result in catastrophic failure.

The present invention is directed to overcoming one or more of the problems as set forth above.

Disclosure of the Invention

In one aspect of the present invention a combustor assembly includes an inlet end portion, an outlet end portion and an intermediate portion. Means are provided for applying radially compressive force on the combustor assembly.

The present invention provides a combustor assembly arrangement which is constructed of a plurality of segments which expand and contract at a different rate of thermal expansion than adjacent segments. The arrangement includes a girdle ring positioned radially adjacent the intermediate portion of the combustor assembly. The girdle ring will allow the combustor assembly to radially expand while maintaining radial compressive force on the combustor assembly to retain radial alignment of the combustor ring segments.

BEST MODE FOR CARRYING OUT THE INVENTION

Figure 1:
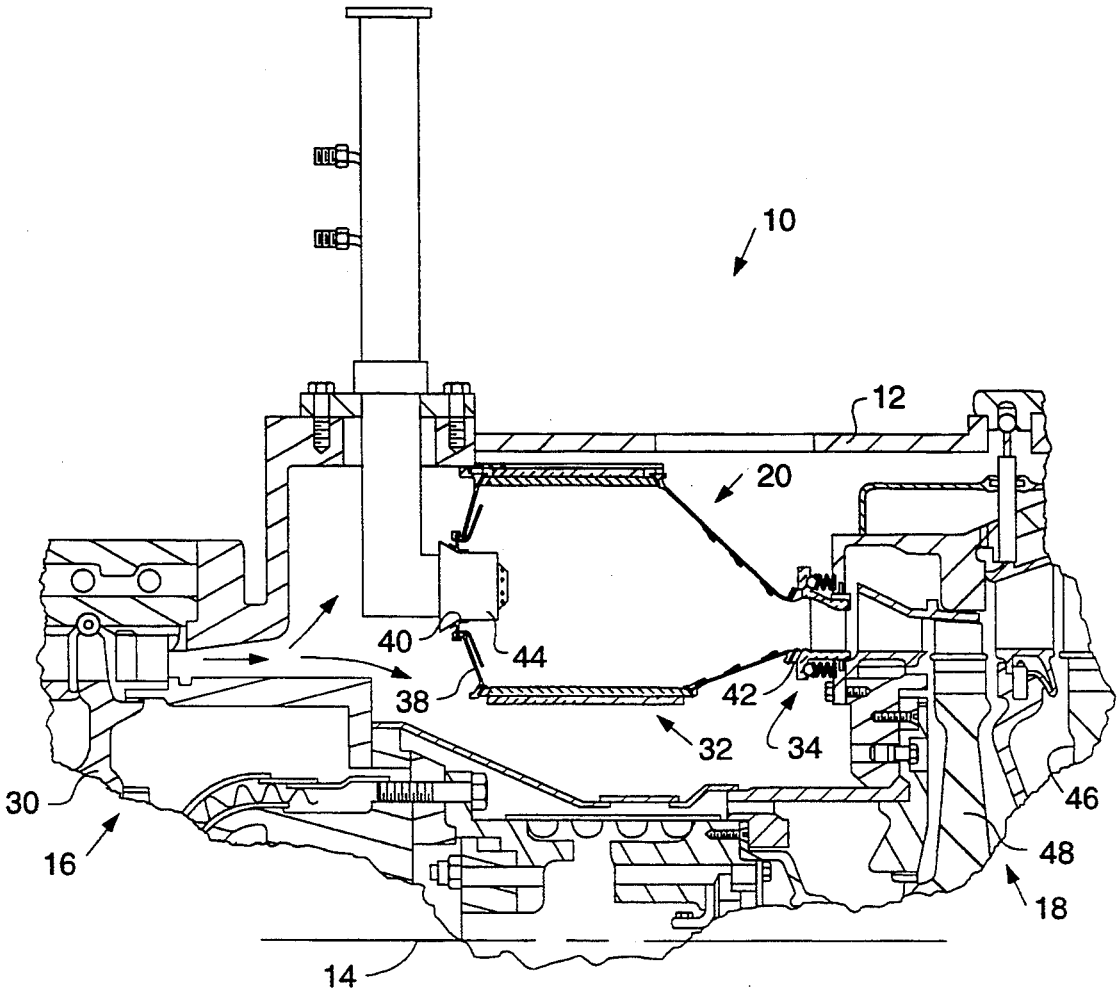
FIG. 1 is a partial view of a gas turbine engine embodying the present invention with portions shown in section for illustration convenience.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30, causes a flow of compressed air which has at least a part thereof communicated to the combustor section 20. The combustor section 20, in this application, includes an annular combustor assembly 32 being supported in the gas turbine engine 10 by an attaching means 34. The combustor assembly 32 has a metallic inlet end portion 38 having a plurality of generally evenly spaced opening 40 therein and a ceramic outlet end portion 42. Each of the openings 40 has an injector nozzle 44 positioned therein. In this application the injector nozzle 44 is of the premix type in which air and fuel are premixed prior to entering the combustor assembly 32.

The turbine section 18 includes a power turbine 46 having an output shaft, not shown, connected thereto for driving an accessary component such as a generator. Another portion of the turbine section 18 includes a gas producer turbine 48 connected in driving relationship to the compressor section 16.

Figure 2:
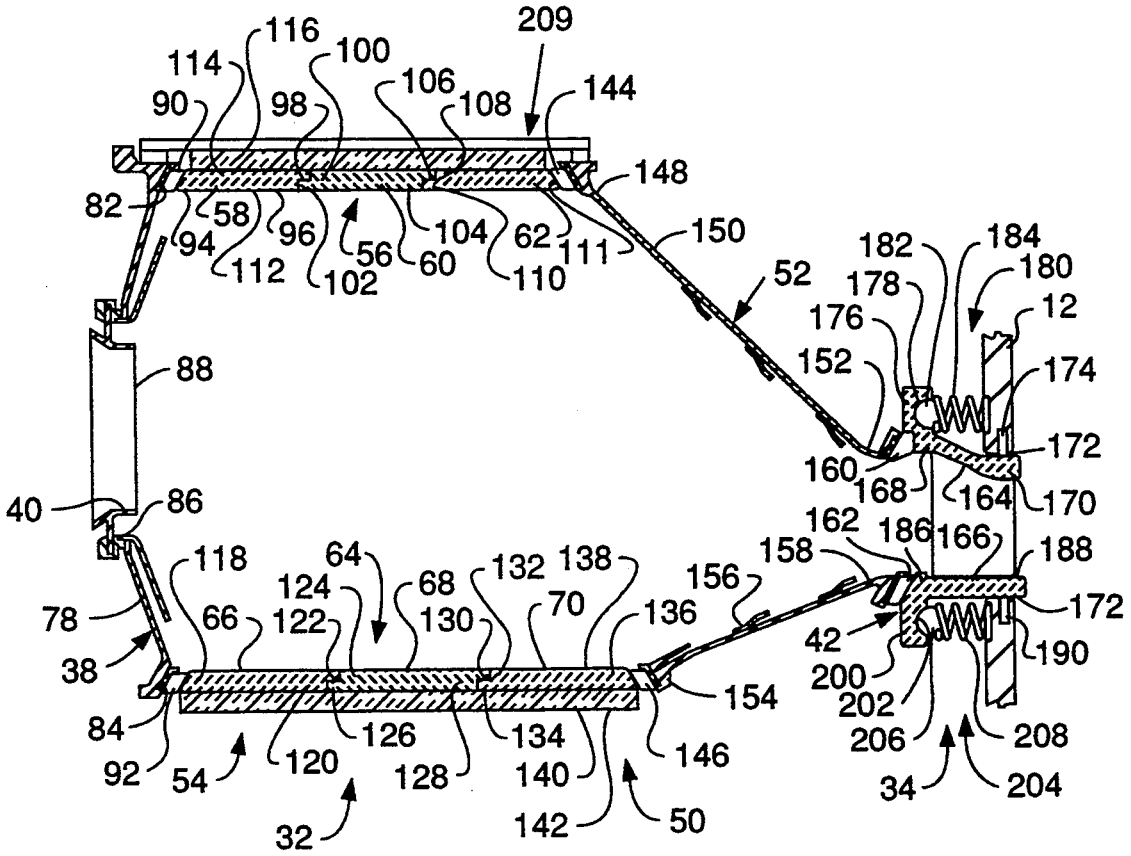
FIG. 2 is an enlarged sectional view of a multipiece combustor.
Figure 3:
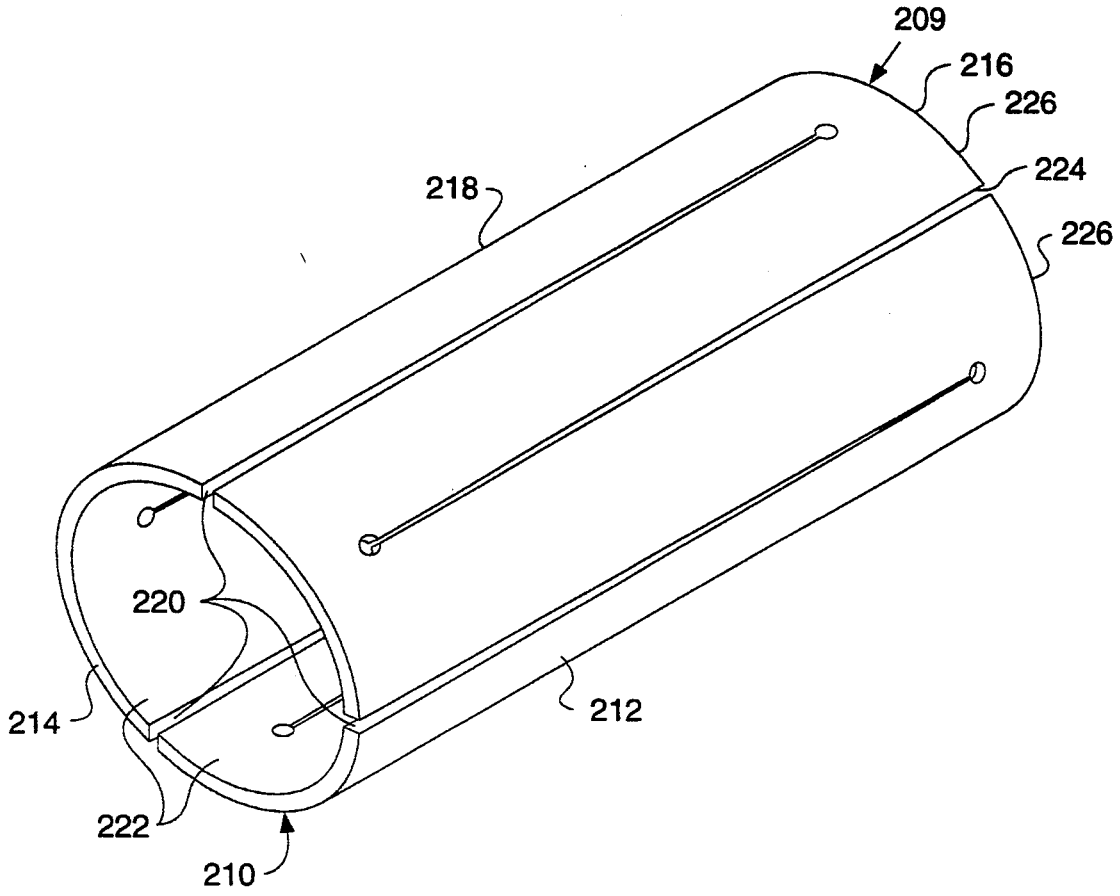
FIG. 3 is an isometric view of a drum spring which will allow for radial thermal expansion of the combustor assembly.

In this application, as best shown in FIG. 2, the combustor assembly 32 is constructed of a plurality of segments 50 being interposed the metallic inlet end portion 38 and the ceramic outlet end portion 42. In this application, the plurality of segments 50 include a metallic section 52 and ceramic section 54 made of a reaction bonded or reaction centered material using silicon as a starting powder. The ceramic section 54 includes an outer combustor ring 56 formed from a first outer segment 58, a second outer segment 60 and a third outer segment 62. The ceramic section 54 further includes an inner combustor ring 64 formed from a first inner segment 66, a second inner segment 68 and a third inner segment 70. However, as an alternative the outer combustor ring 56 and the inner combustor ring could be constructed as one segment. The combustor assembly 32 includes a plurality of bearing assemblies being positioned between adjacent sections to seal the combustor assembly 32 and also prevent surface deterioration during thermal expansion of the sections. The inlet end portion 38 of the combustor assembly 32 includes an end plate 78 which encloses the inlet side of the combustor assembly 32. The end plate 78 has a first bearing surface 82 and a second bearing surface 84. The end plate 78 also has a plurality of generally evenly spaced opening 86 therein positioned between the bearing surfaces 82, 84. A nozzle receiving insert 88 is positioned within the opening 86 of the end plate 78. The nozzle receiving insert 88 contains the opening 40 which is sized and positioned to receive the nozzle 50. A first outer bearing assembly 90 is positioned to contact the first bearing surface 82 of the end plate 78. A first inner bearing assembly 92 is positioned to contact the second bearing surface 84 of the end plate 78. Positioned axially adjacent the first outer bearing assembly 90 is a first end potion 94 of the first outer segment 58. The first outer segment 58 includes a second end portion 96 positioned axially opposite the first end portion 94. The second end portion 96 includes a projection 98 extending axially toward the second outer segment 60. The second outer segment 60 includes a first end portion 100 axially adjacent the second end portion 96 of the first outer segment 60. The first end portion 100 includes a projection 102 which extends axially toward the first outer segment 58 and overlaps the projection 98 of the first outer segment 58. The second outer segment 60 includes a second end portion 104 positioned axially opposite the first end portion 100. The second end portion 104 includes an axial projection 106. The third outer segment 62 includes a first end portion 108 positioned axially adjacent the second end portion 104 of the second outer segment 60. The first end portion 108 includes a projection 110 which axially overlaps the projection 106 of the second outer segment 60. The third outer segment 62 includes a second end portion 111 axially opposite the first end portion 108. The outer combustor ring 56 has a combustor side 112 being spaced from an air side 114. An insulating material 116 is positioned adjacent the air side 114 to contain the heat within the combustor 32. Positioned axially adjacent the second bearing surface 84 is a first end portion 118 of the first inner segment 66. The first inner segment 66 includes a second end portion 120 positioned axially opposite the first end portion 118. The second end portion 120 includes a projection 122 extending axially toward the second inner segment 68. The second inner segment 68 includes a first end portion 124 positioned axially adjacent to the second end portion 120 of the first inner segment 66. The first end portion 124 includes a projection 126 which extends axially toward the first inner segment 66 and overlaps the projection 122 of the first inner segment 66. The second inner segment 66 includes a second end portion 128 positioned axially opposite the first end portion 124. The second end portion 124 includes an axial projection 130. The third inner segment 70 includes a first end portion 132 positioned axially adjacent the second end portion 128 of the second inner segment 68. The first end portion 132 includes a projection 134 which axially overlaps the projection 124 of the second inner segment 68. The third inner segment 70 includes a second end portion 136 positioned axially opposite the first end portion 132. In this application the outer and the inner combustor rings 56, 64 are constructed of a ceramic material. The inner combustor ring 64 has a combustor side 138 being spaced from spaced from an air side 140. An insulating material 142 is positioned adjacent the air side 140 to contain the heat within the combustor 32. A second outer bearing assembly 144 is axially positioned adjacent the second end portion 111 of the third outer segment 70, A second inner bearing assembly 146 is axially positioned adjacent the second end portion 136 of the third inner segment 70. Positioned axially adjacent the second outer bearing assembly 144 is a first end portion 148 of a second outer combustor ring 150. The second outer combustor ring 150 includes a second end portion 152 positioned axially opposite the first end portion 148. Positioned axially adjacent the second inner bearing assembly 146 is a first end portion 154 of a second inner combustor ring 156. The second inner combustor ring 156 includes a second end portion 158 positioned axially opposite the first end portion 154. In this application the second outer and second inner combustor rings 150, 156 are constructed of a metallic material. However, as an alternative the second outer and second inner combustor rings 150, 156 could be constructed of any suitable material such as ceramic. A third outer bearing assembly 160 is positioned axially adjacent the second end portion 152 of the second outer combustor ring 150. A third inner bearing assembly 162 is positioned axially adjacent the second end portion 158 of the second inner combustor ring 156. The outlet end portion 42 includes third outer combustor ring 164 and a third inner combustor ring 166. In this application the third outer and the third inner combustor ring 164, 166 are made of ceramic. The third outer combustor ring 164 has a first end portion 168 positioned axially adjacent the third outer bearing assembly 160 and a second end portion 170 slidably positioned within an opening 172 of the turbine housing 12. The turbine housing 12 includes an outer seal ring 174 between the housing 12 and the second end portion 170. The first end portion 168 includes a flange 176 having a spherical indent 178. A means 180 for applying axially compressive force is axially positioned between the flange 176 and the housing 12. The means 180 includes, a ball 182 positioned within the indent 178, and a spring 184 positioned between the ball 182 and the turbine housing 12. The means 180 allows for axial thermal expansion of the combustor assembly 32. The third inner combustor ring 166 has a first end portion 186 positioned axially adjacent the third inner bearing assembly 162 and a second end portion 188 slidably positioned within the opening 172 of the turbine housing 12. The turbine housing 12 includes an inner seal ring 190 between the housing 12 and the second end portion 188. The first end portion 186 includes a flange 200 having a spherical indent 202. A means 204 for applying axially compressive force is axially positioned between the flange 200 and the housing 12. The means 204 includes, a ball 206 positioned within the indent 202, and a spring 208 positioned between the ball 206 and the turbine housing 12. The means 204 allows for axial thermal expansion of the combustor assembly 32. The bearing assemblies allow for varying thermal expansion between the ceramic components and the metallic components.

A means 209 is provided for applying radial compressive force on the combustor ring 56, 64 while allowing for expansion as the combustor ring 56, 64 is subjected to heat within the combustor assembly 32. The heat will cause thermal expansion within the ring 56, 64 and the means will distribute the force evenly along the ring 56, 64. In this application the means 209 includes a retaining ring or drum spring 210 which is circumferentially positioned around the outer combustor ring 56 and the insulation 116. The retaining ring 210 will retain the insulation in position as the combustor ring 56, 64 expands and contracts. In this application the retaining ring or drum spring is constructed of a metallic material. The retaining ring 210 will help align the segments 58, 60 and 62, but will allow for thermal expansion of the individual segments. In this application the ring is shown around the outer combustor ring 56, however, the ring can be positioned radially adjacent the inner combustor ring 64 or two rings can be used with one being positioned radially adjacent each combustor ring 56, 64. The ring 210 is constructed as a cylindrical tube 212 having a first end portion 214, a second end portion 216 and an intermediate portion 218. A first plurality of slots 220 are equally spaced around the ring 210. The slots 220 extend from the first end portion 214 toward the second end portion 216. The slots 220 stop before reaching the second end portion 216. The area between the slots 220 form a first plurality of fingers 222 which will expand with the thermal expansion of the combustor rings 56, 64, while still maintaining radial compressive force on the combustor ring 56, 64. A second plurality of slots 224 are equally spaced around the ring 210. The second plurality of slots 224 are circumferentially spaced from the first plurality of slots 220. The slots extend from the second end portion 216 toward the first end portion 214. The slots stop before reaching the first end portion 214. The area between the slots 224 form a second plurality of fingers 226 which will expand with the thermal expansion of the combustor ring 56, 64 while still maintaining radial compressive force on the combustor ring 56, 64.

Industrial Applicability

In use, the gas turbine engine 10 is started and allowed to warm up and is used in any suitable power application. As the demand for load or power is increased, the engine 10 output is increased by increasing the fuel and subsequent air resulting in the temperature within the engine 10 increases. The components used to make up the gas turbine engine 10, being of different materials and different rates of thermal expansion, grow at different rates and the forces resulting therefrom and acting thereon must structurally be compensated for to increase life and efficiency of the gas turbine engine. For example, as the fuel and air is injected into the combustor assembly from the injector nozzle 50 the mixture begins to burn. As the burning mixture moves axially along the combustor assembly 32 from the inlet end portion 38 to the outlet end potion 42, the temperature increases to a maximum of about 2500 degrees Fahrenheit. The temperature of the various components each receive a different temperature gradiant from the inlet end portion 38 to the outlet end portion 42 and therefore expand differently and also expand differently from the turbine housing 12. The radial expansion of the individual rings is generally increasing from the inlet end portion 38 toward the outlet end portion 42. Furthermore, the axial expansion of individual ring members differ in the axial direction due to the difference in thermal temperature and different construction axially along the combustor assembly 32 from the inlet end portion 38 to the outlet end portion 42. Thus, the actual expansion, in both the radial and the axial dimension, of the various components differs one from another. Furthermore, the temperature radian along the axial length of an individual member differs and expands dimensionally differently in the radial direction and the axial direction along the axial length of the individual ring members.

To compensate for the difference in radial expansion, means 209 is provided to allow for the expansion while maintaining radial compressive force to keep the various components in radial alignment relationship with each other and distribute force evenly along the combustor ring 56, 64.

In view of the foregoing, it is readily apparent that the structure of the present invention provides an improved combustor assembly 32. The combustor rings 56, 64 which form a portion of the combustor assembly are made of ceramic and are positioned in an overlapping relationship. The combustor rings 56, 64 are formed of a plurality of segments which are positioned in an overlapping relationship and expand and contract radially along the combustor assembly. The combustor rings 56, 64 will expand radially, therefore a means is provided which will allow for the expansion and still maintain radial compressive force on the combustor assembly. The structural arrangement of the joined segments and the material provide a combustor assembly 32 in which higher temperatures can be attained while maintaining structural reliability. The increased temperature reduces emissions and increases efficiencies.

Other aspects, objects and advantages of this invention can be obtained from a study of the drawings, the disclosure and the appended claims.

We claim:

1. A combustor assembly, comprising:

an inlet end portion, an outlet end portion and an intermediate portion; and means for applying radially compressive force on the combustor assembly, said means for applying radially compressive force is a ring having a first end portion., a second end portion and an intermediate portion, said ring being positioned around the intermediate portion of the combustor assembly; and said ring including a first plurality of slots extend from the first end portion toward the second end portion, the first plurality of slots being spaced around the ring.

2. The combustor assembly of claim 1, wherein a second plurality of slots extend from the second end portion toward the first end portion, the second plurality of slots being spaced around the ring circumferentially spaced from the first plurality of slots.

3. The combustor assembly of claim 1, wherein the intermediate portion includes a plurality of segments.

4. The combustor assembly of claim 3, wherein the plurality of segments includes a portion thereof having a generally cylindrical configuration.

5. The combustor assembly of claim 3, wherein the plurality segments include an outer combustor segment and an inner combustor segment.

6. The combustor assembly of claim 5, wherein the outer combustor segment includes a plurality of combustor segments.

7. The combustor assembly of claim 5, wherein the inner combustor segment includes a plurality of combustor segments.

8. The combustor assembly of claim 6, wherein the ring is positioned radially adjacent to the outer combustor segment.

9. The combustor assembly of claim 7, wherein the ring is positioned radially adjacent to the inner combustor segment.

* * * * *